US009486112B2

(12) United States Patent
Parikh et al.

(10) Patent No.: US 9,486,112 B2
(45) Date of Patent: Nov. 8, 2016

(54) LIVING HINGE CREATION THROUGH EXTRUSION OF A THERMOFORMABLE PLASTIC SHEET

(75) Inventors: Nirav D. Parikh, Sylvania, OH (US); Michael Glenn Geels, Jackson, TN (US)

(73) Assignee: Delta Faucet Company, Indianapolis, IN (US)

( * ) Notice: Subject to any disclaimer, the term of this patent is extended or adjusted under 35 U.S.C. 154(b) by 529 days.

(21) Appl. No.: 13/884,284

(22) PCT Filed: Sep. 2, 2011

(86) PCT No.: PCT/US2011/050361

§ 371 (c)(1),
(2), (4) Date: Aug. 13, 2013

(87) PCT Pub. No.: WO2012/067698

PCT Pub. Date: May 24, 2012

(65) Prior Publication Data

US 2014/0007340 A1 Jan. 9, 2014

Related U.S. Application Data

(60) Provisional application No. 61/413,575, filed on Nov. 15, 2010.

(51) Int. Cl.

| | |
|---|---|
| ***A47K 3/02*** | (2006.01) |
| ***A47K 3/04*** | (2006.01) |
| ***A47K 3/30*** | (2006.01) |
| ***B05D 3/12*** | (2006.01) |
| ***A47K 3/16*** | (2006.01) |

(52) U.S. Cl.

CPC . *A47K 3/04* (2013.01); *A47K 3/02* (2013.01); *A47K 3/16* (2013.01); *A47K 3/30* (2013.01); *B05D 3/12* (2013.01); *Y10T 29/49* (2015.01); *Y10T 29/49826* (2015.01)

(58) Field of Classification Search

CPC ..... A47K 3/02
USPC ..... 4/538–595
See application file for complete search history.

(56) References Cited

U.S. PATENT DOCUMENTS

| | | | | | |
|---|---|---|---|---|---|
| 2,677,268 | A | * | 5/1954 | Hobbs | 52/35 |
| 2,853,714 | A | * | 9/1958 | Darmstadt | 4/580 |
| 3,088,124 | A | * | 5/1963 | Long | 4/593 |
| 3,629,875 | A | * | 12/1971 | Dow et al. | 4/599 |
| 3,751,737 | A | * | 8/1973 | Mustee | 4/608 |
| 3,827,086 | A | * | 8/1974 | Seymour et al. | 52/35 |
| 4,067,071 | A | * | 1/1978 | Altman et al. | 4/546 |
| 4,152,789 | A | * | 5/1979 | Heath | 4/614 |
| D252,940 | S | * | 9/1979 | Alexander | D23/275 |
| D252,943 | S | * | 9/1979 | Chisholm et al. | D23/305 |

(Continued)

OTHER PUBLICATIONS

International Search Report from PCT/US11/50361.

*Primary Examiner* — Lori Baker
(74) *Attorney, Agent, or Firm* — Carlson, Gaskey & Olds, PC

(57) ABSTRACT

A bathing vessel is made of a sheet of layered materials, which include a first layer of polyurethane material, a second layer of polyurethane material attached to the first layer, a third layer of acrylonitrile butadiene styrene (ABS) material attached to the second layer, and a fourth layer of acrylic material attached to the third layer. A first narrowed portion about which the sheet bends is provided. The bend defines a first wall and a second wall in the sheet.

28 Claims, 3 Drawing Sheets

(56) References Cited

U.S. PATENT DOCUMENTS

| | | | | | |
|---|---|---|---|---|---|
| D252,944 | S | * | 9/1979 | Chisholm et al. | D23/305 |
| D254,148 | S | * | 2/1980 | Alexander | D23/275 |
| 4,346,485 | A | * | 8/1982 | Reed et al. | 4/555 |
| 4,365,367 | A | * | 12/1982 | Houle et al. | 4/555 |
| 5,208,924 | A | * | 5/1993 | Smith et al. | 4/584 |
| 5,418,048 | A | * | 5/1995 | Daff | B29C 51/02 4/538 |
| 5,580,621 | A | * | 12/1996 | Kuszaj et al. | 428/34.1 |
| 5,776,605 | A | * | 7/1998 | May | 428/354 |
| 5,778,463 | A | * | 7/1998 | Teckchandani et al. | 4/538 |
| 5,829,071 | A | * | 11/1998 | Lavalle | 4/580 |
| 6,996,860 | B1 | * | 2/2006 | Blake et al. | 4/580 |
| 8,800,073 | B2 | * | 8/2014 | Hoernig et al. | 4/614 |
| 2006/0230515 | A1 | * | 10/2006 | Wilson et al. | 4/538 |
| 2007/0266646 | A1 | * | 11/2007 | Hatrick-Smith | 52/35 |
| 2013/0219610 | A1 | * | 8/2013 | Geels | 4/584 |

* cited by examiner

LIVING HINGE CREATION THROUGH EXTRUSION OF A THERMOFORMABLE PLASTIC SHEET

RELATED APPLICATION

This application claims priority to U.S. Provisional Application No. 61/413,575, which was filed Nov. 15, 2010.

TECHNICAL FIELD

This application relates to extruding of plastic material and more specifically to the extrusion of bath surrounds with a living hinge.

BACKGROUND OF THE INVENTION

Typically to extrude bath surrounds or other parts, raw material is fed into a feed hopper which in turn provides a screw that passes from material through a heater. The material is pushed through a die and then may be pushed through coating equipment and extruded towards a trim knife. The cooling material is frequently passed through pull rollers.

Bath surrounds for tubs or for showers are usually one piece or several pieces. The one piece surrounds typically have two sidewalls and a back wall. Such one piece construction is problematic in that it is sometimes difficult to handle, difficult to get into a bathroom and expensive to ship because of the odd shapes that are not always nestable. They are also subject to damage while being handled.

To overcome these problems, surrounds may be created with three separate parts or two separate parts. The three part surrounds include a separate sidewall and a separate back portion. These walls can then be easily stacked and packed and shipping is easier as is placing the product into the bathroom for installation. However, many designs require that the corners be mated carefully such that leakage does not occur between or within seams between the sidewalls and the back wall. Also, caulk is usually used to seal the joints so that leakage does not get behind the walls thereof.

Bathing vessels may be manufactured from a variety of different materials, such as plastic materials. Plastic bathing vessels, however, must meet certain minimum performance requirements. For instance, the American National Standards Institute (ANSI) sets forth minimum physical requirements and testing methods for plastic bathtub and shower units. A bathing vessel that meets the requirements is approved for use in homes, buildings or other structures as a plumbing fixture.

SUMMARY OF THE INVENTION

According to an embodiment disclosed herein, a bathing vessel is made of a sheet of layered materials. A first narrowed portion about which the sheet bends is provided. The bend defines a first wall and a second wall in the sheet.

According to a further embodiment disclosed herein, a bathing vessel is made of a sheet of layered materials, which include a first layer of polyurethane material, a second layer of polyurethane material attached to the first layer, a third layer of acrylonitrile butadiene styrene (ABS) material attached to the second layer. The sheet has a first narrowed portion about which the sheet bends. The bend defines a first wall and a second wall in the sheet.

According to a still further embodiment disclosed herein, a method of constructing a bathing vessel includes providing a sheet of layered materials made of a first layer of polyurethane material, a second layer of polyurethane material attached to the first layer, a third layer of acrylonitrile butadiene styrene (ABS) material attached to the second layer. Other steps include creating a first narrowed portion in the layered materials and bending the sheet about the first narrowed portion for shipping or storage.

These and other features of the present invention can be best understood from the following specification and drawings, the following of which is a brief description.

DETAILED DESCRIPTION OF THE PREFERRED EMBODIMENT

Figure 1:
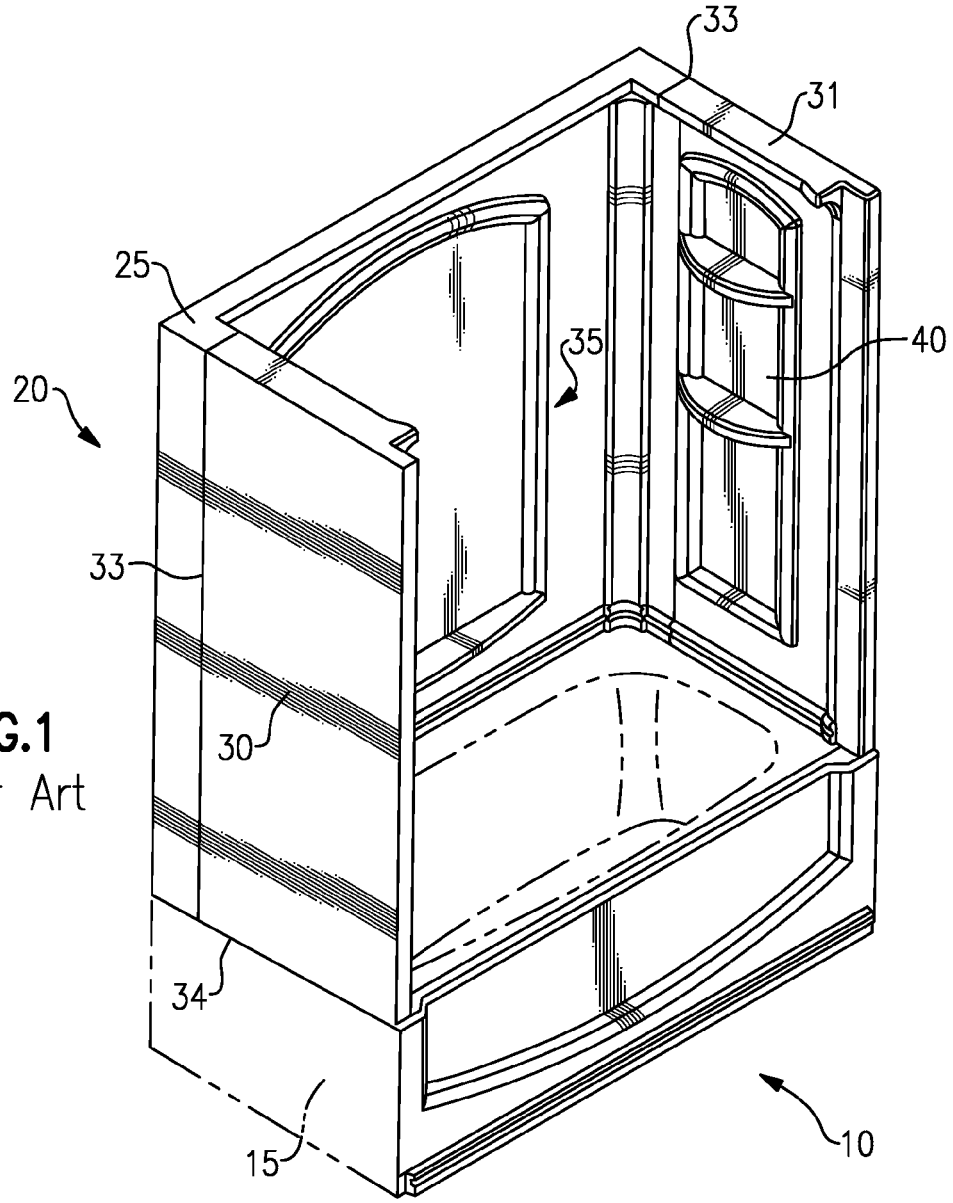
FIG.1 Prior Art
FIG. 1 is a prior art version of a tub surround.
Figure 2:
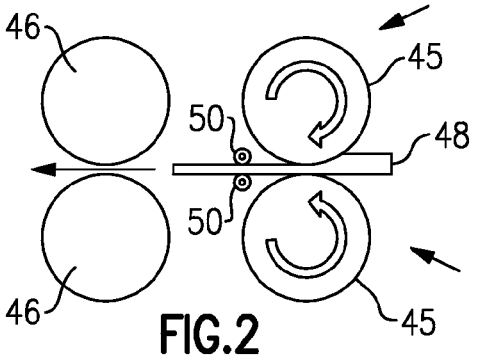
FIG. 2 is a side view of an extrusion die rollers that are used to construct a panel for use in a shower enclosure.
Figure 3:
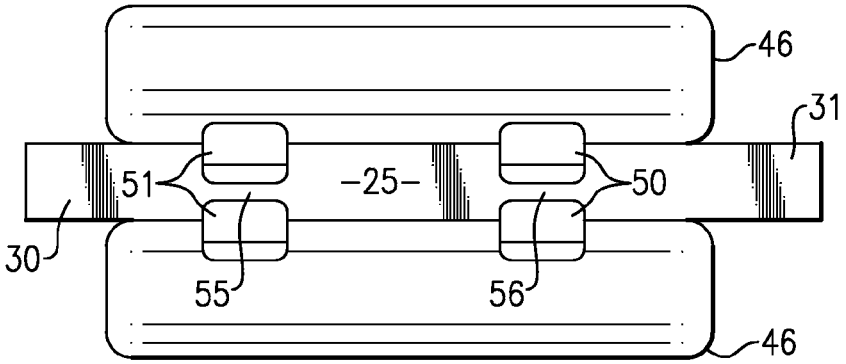
FIG. 3 is a back view of the extrusion die rollers of FIG. 2.

Referring to FIG. 1, a typical prior art view of a one piece bathing vessel 10 includes a tub 15, a surround 20 having three pieces sidewall 30, sidewall 31 and back wall 25 is shown. In this embodiment, the sidewalls 30 and 31 are connected to the back wall 25 at seams 33. Seam 34 connects the sidewalls 30, 31 and the back wall 25 to the tub. Some surrounds known in the prior art are shipped in one piece without seams 33 and without seams 34. Such Referring now to FIGS. 2 and 3, material 48 is extruded through extrusion rollers 45 and is pulled after extrusion by pulling rollers 46, a pair of hinge rollers 50 are impressed into the material 48 to create grooves narrowed portions 55, 56 that become living hinges of a shower surround 20. The rollers 50 are spaced apart such that the edges of the extruded material, after a cutting process (not shown), become surround walls 30, 31 and the area between the rollers 45 becomes the back wall 25. Though not shown to scale, one of the hinge rollers 50 may be narrower or wider than the other such that the grooves or narrowed portions 55, 56 may be of different widths. By modifying placement of the hinge rollers 50, towards or away from each other along a width of the material 48 downstream of the extrusion rollers 45, the width of the back portion 25 and the width of the side portions 30, 31 may be modified. Though two hinge rollers 50 are shown, more or less hinge rollers may be necessary. For instance, if a bathing vessel, such as a shower enclosure only needs two walls (the rest may be glass or a curtain) only one hinge roller is necessary. Similarly, if more bends are required for a more complex surround 20 more hinge rollers 50 may be provided. Furthermore, other types of rollers or presses may be used to create the narrowed portions 55, 56.

Figure 4:
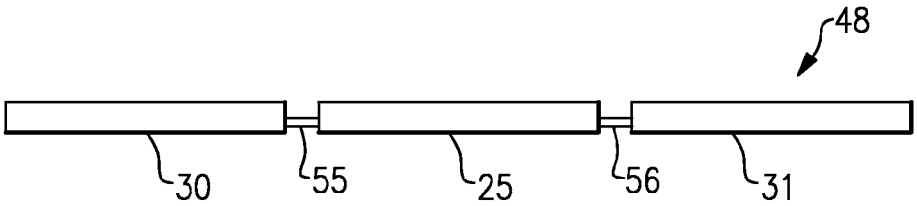
FIG. 4 is a top or a bottom view of the wall sections of a bath surround after being subjected to the rollers of FIG. 3.

Referring now to FIG. 4, a side view of the wall material 48 after it passes through the hinge rollers 50 is shown. The material 48 is a straight section having sidewalls 30, 31, and back wall 25 joined by living hinges 55*a*, 56*a*. The material 48 is ready for shipping and/or storage.

Figure 5:
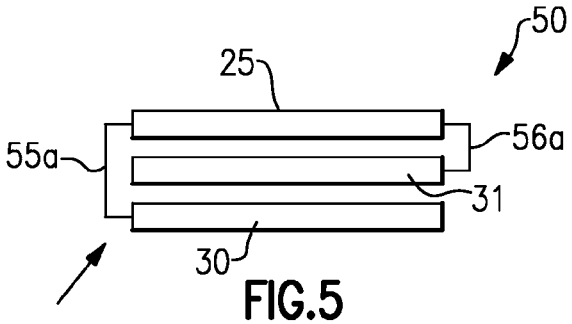
FIG. 5 is a top view of surround in an installed position.

Referring now to FIG. 5, hinge 55*a* and 56*a* are bent so that the material 48 may be shipped handled and stored. Hinge 55*a* is longer (i.e., wider) than hinge 56*a*. Therefore, hinge 56 is bent to attach or bend wall 31 into close proximity or touching the back wall 25 and longer hinge 55*a* is then bent to allow wall 30 to be folded over and to be in close proximity or touching wall 31. The wall surround 20 is then a more efficient configuration to ship, handle and install.

Figure 6:
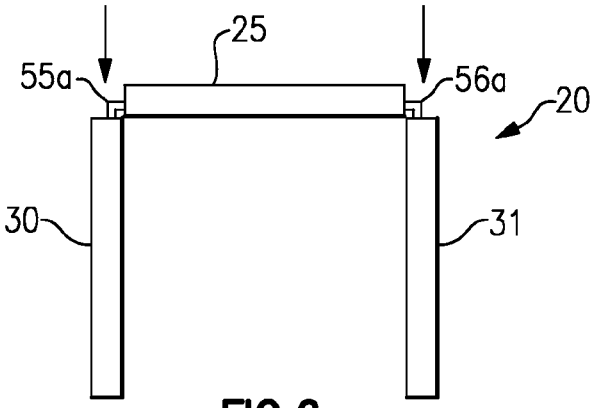
FIG. 6 is a view of the walls of FIG. 4 in a shipping position.
Figure 7:
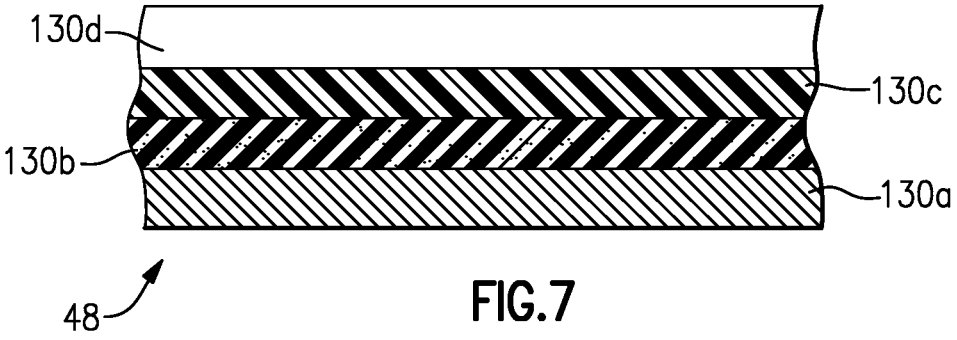
FIG. 7 shows a side view of the structure of the wall sections.

Referring now to FIG. 6, the walls 30, 31 and 25 are unbent as if on site so that the walls are in close proximity to each other at the joints or hinges 55*a* and 56*a* so that a use of caulking may be minimized or eliminated. The walls may be installed on top of the tub 15 or a shower base (not shown) or the like. Note that because of the proximity of the walls 30, 31 and 25, any leakage behind the walls is stopped by the hinges 55*a*, 56*a* from leaking behind surround 20. Alternatively, if the roller 51 and the rollers 50 are the same width, the sheet may be shipped, stored or handled flat and then bent in situ to create a surround 20.

In embodiments, the layer of acrylic material 130*d* is arranged on the first layer of polyurethane material 130*a*, the layer of acrylonitrile butadiene styrene (ABS) material 130*c* is arranged between the layer of acrylic material 130*d* and the first layer of polyurethane material 130*a*, and the second layer of polyurethane material 130*b* is arranged between the layer of ABS material 130*c* and the first layer of polyurethane material 130*a*. In some examples, additional layers may be arranged among the layers 130*a-d*. In other examples, the walls 25, 30, 31 include only the layers 130*a-d* and are free of other layers, materials, adhesives, or the like. The walls 25, 30, 31 may have thicknesses between 0.20 to 0.30 inches with 0.25 inch preferred. Similarly the hinges 55*a*, 56*a* may be between 0.020 and 0.10 inches with 0.025 preferred. The ratio between the thickness of the walls to the thickness of the hinges is 15-2:1 with a preferable ratio of 10-5:1 and a more preferable ratio of 8.3:1.

The thicknesses of the individual layers 130*a-d* is not necessarily shown to scale and may vary, depending on the desired wall strength and location in the wall 25, 30, 31, for example. In embodiments, the ratio of the thickness of the layer of acrylic material 130*d* to the thickness of the layer of ABS material is no greater than 1, to facilitate meeting strength requirements.

In embodiments, the first layer of polyurethane material 130*a*, the second layer of polyurethane material 130*b*, or both, are foamed polyurethane materials. In some examples, the density of the first layer of polyurethane material 130*a* is different than the density of the second layer of polyurethane material 130*b*. For instance, the density of the first layer of polyurethane material 130*a* is greater than the density of the second layer of polyurethane material 130*b*, to facilitate achievement of a desired degree of strength of the walls 24.

In a further example, the second layer of polyurethane material 130*b* is a rigid layer and has a density of 1-10 pounds per cubic foot. The first layer of polyurethane material 30*a* is an elastomeric layer and has a density of about 25-65 pounds per cubic foot though in some examples approximately 55-65 pounds per cubic foot are used. In one example, the density is approximately 62 pounds per cubic foot.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A bathing vessel, said bathing vessel comprising:
a sheet of layered materials,
wherein said sheet has a first narrowed portion about which said sheet bends and wherein said bend defines a first wall and a second wall contiguous to the first wall about said first narrowed portion.

2. The bathing vessel of claim 1 wherein said sheet has a second narrowed portion about which said sheet bends and wherein the second narrowed portion forms a third wall contiguous to the second wall.

3. The bathing vessel of claim 2 wherein said second narrowed portion has a width wider than a width of said first narrowed portion wherein upon bending about said first narrowed portion said first wall is proximate to said second wall.

4. The bathing vessel of claim 3 wherein upon bending about said second narrowed portion said third wall is proximate to said second wall.

5. The bathing vessel of claim 1 wherein said first wall and said second wall form an angle greater than zero degrees to each other.

6. The bathing vessel of claim 1 wherein a ratio of a thickness of said first wall to a thickness of said first narrowed portion is from 15-2:1.

7. The bathing vessel of claim 6 wherein the ratio is from 10-5:1.

8. The bathing vessel of claim 7 wherein the ratio is 8.3:1.

9. The bathing vessel of claim 1 wherein said layered materials includes:
a first layer of polyurethane material,
a second layer of polyurethane material attached to said first layer,
a third layer of acrylonitrile butadiene styrene (ABS) material attached to said second layer, and
a fourth layer of acrylic material attached to said third layer.

10. The bathing vessel of claim 9 wherein said acrylic material comprises polymethylmethacrylate.

11. A bathing vessel, said bathing vessel comprising:
a sheet of layered materials, said layered materials including;
a first layer of polyurethane material,
a second layer of polyurethane material attached to said first layer, and a
a third layer of acrylonitrile butadiene styrene (ABS) material attached to said second layer,
wherein said sheet has a first narrowed portion about which said sheet bends wherein said bend defines a first wall and a second wall contiguous to the first wall about said first narrowed portion.

12. The bathing vessel of claim 11 wherein said sheet has a second narrowed portion about which said sheet bends and wherein said third sheet and said second sheet form a third wall and a second wall about said second narrowed portion.

13. The bathing vessel of claim 12 wherein said second narrowed portion has a width wider than a width of said first narrowed portion and wherein the second narrowed portion forms a third wall contiguous to the second wall.

14. The bathing vessel of claim 13 wherein upon bending about said second narrowed portion said third wall is proximate to said second wall.

15. The bathing vessel of claim 11 wherein said first wall and said second wall form an angle greater than zero degrees to each other.

16. A method of constructing a bathing vessel comprising:
providing a sheet of layered materials, said layered materials including; a first layer of polyurethane material, a second layer of polyurethane material attached to said first layer, and a third layer of acrylonitrile butadiene styrene (ABS) material attached to said second layer,
creating a first narrowed portion in said layered materials
bending said sheet about said first narrowed portion for shipping or storage.

17. The method of claim 16 further comprising unbending said sheet about said narrowed portion to create a first and second wall of said bathing vessel.

18. The method of claim 17 further comprising:
creating a second narrowed portion in said sheet,
bending said sheet about a second narrowed portion for shipping or storage.

19. The method of claim 18 further comprising unbending said sheet about said second narrowed portion to create a third wall of said bathing vessel.

20. The method of claim 19 further comprising wherein said second narrowed portion has a width that is wider than a width of said first narrowed portion and bending about said first narrowed portion such that said first wall is proximate to said second wall.

21. The method of claim 20 wherein said first wall touches said second wall.

22. The method of claim 19 further comprising the step of:
bending said sheet about said second narrowed portion such that said third wall is proximate to said second wall.

23. The method of claim 16 further comprising:
shipping said sheet.

24. The method of claim 16 further comprising:
unbending said sheet for installation after shipping.

25. The method of claim 19 further comprising
installing said sheet.

26. The method of claim 16 wherein the sheet of layered materials has a first thickness and the first narrowed portion formed in the sheet of layered materials has a second thickness that is less than the first thickness.

27. The bathing vessel of claim 1 wherein the sheet of layered materials has a first thickness and the first narrowed portion formed in the sheet of layered materials has a second thickness that is less than the first thickness.

28. The bathing vessel of claim 11 wherein the sheet of layered materials has a first thickness and the first narrowed portion formed in the sheet of layered materials has a second thickness that is less than the first thickness.

* * * * *